US005637386A

United States Patent [19]

Darjee

[11] Patent Number: 5,637,386

[45] Date of Patent: Jun. 10, 1997

[54] FINING ABRASIVE MATERIALS

[75] Inventor: Dhiraj H. Darjee, Ballston Lake, N.Y.

[73] Assignee: Norton Company, Worcester, Mass.

[21] Appl. No.: 565,933

[22] Filed: Dec. 1, 1995

Related U.S. Application Data

[63] Continuation of Ser. No. 370,901, Jan. 10, 1995, abandoned.

[51] Int. Cl.[6] ..... D03D 17/00; D04B 1/00

[52] U.S. Cl. ..... 428/156; 428/168; 428/197; 428/206; 428/208; 428/210; 428/219; 51/308; 51/309; 451/527; 451/534

[58] Field of Search ..... 428/168, 197, 428/240, 156, 206, 208, 210, 219, 230, 245, 253; 51/308, 309; 451/527, 534

[56] References Cited

U.S. PATENT DOCUMENTS

| | | | |
|---|---|---|---|
| 3,608,044 | 9/1971 | Coplan | 264/210.7 |
| 3,971,234 | 7/1976 | Taylor | 66/200 |
| 4,202,139 | 5/1980 | Hong et al. | 451/524 |
| 4,606,154 | 8/1986 | Herrmann et al. | 451/533 |
| 4,725,487 | 2/1988 | Pemrick et al. | 428/240 |
| 4,733,502 | 3/1988 | Braun | 51/284 |
| 4,788,798 | 12/1988 | DeFranco et al. | 51/406 |
| 5,011,513 | 4/1991 | Zador et al. | 51/295 |
| 5,014,468 | 5/1991 | Ravipati et al. | 51/295 |
| 5,028,242 | 7/1991 | Ito et al. | 51/295 |
| 5,135,546 | 8/1992 | Sato et al. | 51/295 |
| 5,219,462 | 6/1993 | Bruxvoort et al. | 51/293 |
| 5,304,223 | 4/1994 | Pieper et al. | 51/293 |

OTHER PUBLICATIONS

New Riverside Dictionary by the Riverside Publishing Company 1984 p. 421.

*Primary Examiner*—Kathleen Choi
*Attorney, Agent, or Firm*—David Bennett

[57] ABSTRACT

A coated abrasive suitable for fining operations on contoured surfaces is obtained by depositing an abrasive/bond mixture in a discontinuous pattern on the surface of a backing that is stretchable in such a fashion that the finished product remains stretchable.

6 Claims, No Drawings

FINING ABRASIVE MATERIALS

This application is a continuation of application Ser. No. 08/370,901 filed on Jan. 10, 1995, now abandoned.

BACKGROUND OF THE INVENTION

The present invention relates to coated abrasives and specifically to coated abrasives that are particularly adapted to producing a fine finish on a hard surface.

When polishing hard surfaces such as glass for optical purposes or silicon wafers for the production of computer chips, it is common to use lapping or fining materials. These are often applied in the form of a slurry using a flexible and resilient pad. However in many circumstances, notably when the surface to be lapped or finished is curved as in the case of optical lenses, it is preferred to use a coated abrasive. One type of fining product comprises a disc cut to resemble a multibladed propeller. Such discs are variously referred to as "daisy wheel" or "snowflake" pads. This configuration enables the pad to conform more closely to the surface of the curved surface. The backing on such pads, though flexible, is essentially non-elastic and can not readily conform completely to the surface to be finished and thus is not fully satisfactory. In a different way of using such discs, the disc is supported on a lap tool having the desired curvature and a lens blank is pressed against the supported disc and rotated so as to abrade the surface till it possesses the same curvature as the lap tool. Such a process is described in U.S. Pat. No. 4,733,502.

In all fining or lapping processes applied to curved surfaces and employing a coated abrasive material, the key problem is that of conforming the coated abrasive exactly to the curved surface that is to be finished. Because the coated abrasive is essentially planar and because the abrasive grits are usually held in place by relatively inflexible and inelastic maker and size coats, no matter how flexible the backing, the planar coated abrasive cannot easily conform itself to a curved surface so as to substantially equalize the pressure at all locations on the surface.

To diminish the problem as it relates to the relatively stiff maker and size coats, it has been proposed that a more flexible bond material be used and that the maker and abrasive be applied to the surface of a "snowflake" pad so as to produce a series of spaced islands of abrasive, or a pattern of abrasive areas. This approach is described for example in U.S. Pat. No. 5,014,468 and the result is certainly increased flexibility, especially when used in conjunction with more UV-curable, flexible maker coats.

A novel approach has now been developed to this problem. It provides a coated abrasive that is very flexible and resilient such that it can readily be adapted to the difficult abrading situations referred to above. This approach allows the use of conventional maker and size coat materials which are well understood and highly versatile. It can also be used with conventional fine grit abrasive materials. The invention therefore provides a versatile and effective coated abrasive of particular utility in fine finishing curved surfaces such as plastic lenses.

The present invention also provides a process for making a fining coated abrasive material having the above desirable characteristics.

DESCRIPTION OF THE INVENTION

The present invention provides a coated abrasive material having length and width dimensions wherein the material has at least 80%, and preferably substantially 100%, recovery when subjected to a strain producing a 50%, and preferably 90%, elongation in the length direction, or 25%, and more preferably 35%, in the width direction, said coated abrasive comprising abrasive materials deposited on a surface of the material in spaced discontinuous patterns.

In order to achieve the necessary elasticity in the coated abrasive, it is clearly necessary to have at least the same degree of elasticity in the substrate on which the abrasive materials are deposited and preferably more. This can clearly be achieved by the use of elastic fibres or filaments in a woven structure. An alternative approach which is often preferred is the use of a knit fabric that includes laid-in elastic fibers. Such knit fabrics are well known in the art and are used to produce elastic garments such as womens' hose and support garments of various sorts. It is also possible in principle to use woven or non-woven fabrics made from basically inelastic fibers that have been subjected to extensive crimping or bulking so as to give them the capacity to expand, (by straightening out), upon being strained and yet return to the crimped configuration when the strain has been removed. However unless the fabric construction is specially adapted, such materials are not well suited for use in the present coated abrasive products since the force tending to restore the unstretched dimensions tends to diminish at elevated temeperatures and with time.

A suitable fabric for use in the production of the coated abrasives of the invention is an elastic knit fabric. Such fabrics are generally knit from nylon or polyester continuous filament yarns and have an elastic yarn filament laid in between the knit yarns. The knit can be of the tricot or raschel or any similar knitted or stitch-bonded system that gives the same elastic possibilities. Other suitable fabrics include for example a lofty tangled continuous filament material with the filaments bonded together at at least some of their points of contact. One suitable elastic filament/yarn is available from DuPont Company under the registered Trademark "Spandex" and comprises an elastic yarn sold under the registered Trade mark "Lycra". Suitable knit fabrics are available from Guilford Mills.

It is important for the intended applications that the overall weight and thickness of the backing be not excessive. It is therefore preferred that the weight of the elastic fabric used as the backing in the present invention be less than about 220, and more preferably less than about 180, $g/m^2$. The lower limit is determined at least in part by the conditions of use but generally the weight should not be less than about 100 $g/m^2$. The weight is in part dependent on the denier of the yarns used and this is preferably less than about 140 denier and more preferably still, less from about 20 to about 40 denier.

It is important that the abrasive material be deposited on the surface of the substrate in a discontinuous pattern. This places minimum constraint on the stretching of the coated abrasive as a result of the bond material by which the abrasive is retained on the surface of the coated abrasive. As will be appreciated a continuous coat of a relatively inextensible resin will tend to lead to inextensibility and the same problems in conforming the coated abrasive material to the surface to be finished that have made the prior art materials less than satisfactory. Additionally the spaces between the abrasive areas allow abraded material to collect without interfering with continued abrading operations.

In one embodiment of the invention the coated abrasives are made by applying the abrasive grit in admixture with the bond material in the form of a slurry by means of a rotogravure roller so as to lay a discontinous pattern of applications of the grit/bond slurry on the surface. It is also possible to lay down the bond material in a first operation and then, in a separate operation, deposit the abrasive grits in conventional fashion so as to adhere only in those places having the bond resin. This second alternative is not generally preferred as it introduces a second stage and requires a means to remove the excess grit that does not adhere.

The pattern in which the grit is applied should not be selected so as to result in significant constraint on the extensibility of the substrate when the bond component is cured. Thus a pattern of spaced round patches is often preferred.

In a preferred embodiment the backing material has a knit structure with a surface comprising a plurality of raised areas, referred to as knuckles, where the knit yarn stands out of the general plane of the knit fabric. This is a common feature of tricot or raschel-knit fabrics. When such surfaces are treated with a slurry of bond and abrasive grits using a roller applicator the slurry adheres only to the knuckles and thus forms a pattern of isolated areas corresponding to the knuckles in the fabric. To a lesser extent the same result may be obtained using certain woven structures where the warp and fill yarns are elastic. Such fabrics also have surfaces with raised portions corresponding to the passage of a fill yarn over a warp yarn or vice versa.

The abrasive used is typically a fine particle size alumina having a narrow particle size range. Typical materials have a particle size from about 1 to 10 microns and preferably from 3 to 5 microns with at least 50% of the particles having sizes within a micron of the nominal average particle size. Aluminas of this type include white calcined alumina, (WA 3000) available from Fujimi Corporation; and Electronics Grade Precision Alumina, available from Saint-Gobain/Norton Industrial Ceramics, Materials Division.

Because the slurry can tend to flow to the spaces between the desired patterns it is often preferred to apply the slurry to the substrate while the substrate is in the relaxed state and then to place the substrate under strain so as to expand the material and separate the treated areas so as to ensure that the treated areas are well separated in discontinuous patterns on the substrate.

The discontinuous pattern of abrasive areas in the finished product is very advantageous as it results in a more open structure in which abraded material can be collected in the spaces between the abrasive areas without interfering with the abrading operation.

A very significant advantage of the materials of the invention is their great flexibility and extensibility. This makes it possible to conform the abrading surface to curved surfaces and to subject them to uniform abrading forces.

DESCRIPTION OF THE PREFERRED EMBODIMENTS

The backing material used in the resilient coated abrasive materials according to the invention is preferably a fabric knit from an elastic bicomponent yarn in which one component has been induced to shrink so as to compel the yarn to adopt a coiled or otherwise crimped configuration. The knit technique used can be any of those connnonly used to produce knit fabrics, particularly those that result in a pattern of raised knuckles on at least one surface of the knit fabric. Suitable knitting patterns include for example raschel and tricot.

It is also possible to use a non-woven fabric in which two or more arrays of elastic yarns are laid across one another and stitch bonded together using a third yarn in such a fashion as to result in a spaced pattern of raised knuckles on one surface of the fabric.

Certain weaves of elastic fabrics can also be used if they can satisfy the elasticity requirements for the woven fabric. Once again however it is preferred that the weave of the fabric should result in a pattern of isolated raised areas on one surface. Weaves that give rise to such patterns include for example terry or towel loops and jacquard weaves with at least one warp being a "Spandex"-type yarn.

The binder used can conveniently be any of those used in the manufacture of coated abrasives including phenolic resins, melamine/formaldehyde resins, polyurethanes, radiation or UV-curable acrylate resins and the like. For most purposes a UV-curable acrylate-modified polyurethane resin is the preferred binder.

The abrasive grit is conveniently alumina, which may be sintered or fused, but in some applications diamond or cubic boron nitride may be preferred. For most applications an alumina is preferred either alone or in admixture with another abrasive such as diamond.

The pattern of application of the abrasive is a matter of choice provided that the abrasive areas are separated from one another and the deposited structure does not impair the elasticity of the coated abrasive material to the extent it does not meet the standards described above. Often two or more coatings may be desirable to ensure that a sufficient amount of abrasive is applied while still observing the limitations regarding spaced patterns and discontinuity recited above.

The coated abrasive product of the invention may be in the form of a disc, such as a "daisy wheel" disc, or a belt depending on the equipment with which it is to be used. In one approach a "bean bag" support is used that conforms itself to the shape to be ground. To be effective the coated abrasive must also conform to the desired shape and thus a disc may be the preferred configuration. The support may also be formed from a resilient material having elastic memory such that it can return to a predetermined shape after deformation. One such material is sold under the registered Trademark "Sorbothane" by Sorbothane Inc. In such case the preferred configuration may be a strip.

DESCRIPTION OF SPECIFIC EMBODIMENT

The invention is now described in the context of certian specific materials and their performance as fining abrasives. These are for the purpose of illustration only and are not intended to imply any necessary limitation on the essential scope of this invention.

EXAMPLE 1

This Example describes the use of abrasive products made using a number of different substrates together with the same abarsive binder mix. In each case the products were evaluated in the fining of the surface of a plastic lens.

The abrasive/binder formulation used in the evaluations comprised 70% by weight of 3 micron alpha alumina abrasive particles and 30% by weight of a binder material comprising an acrylate-modified polyesterurethane sold under the trade name Celord 3600 by Unirez Corporation. The formulation was applied to the fabric in an untensioned form, (beyond that imposed by passage over a roller), using a rotogravure roller depositing the mixture in a series of repeating patterns according to the technique described in U.S. Pat. No. 5,014,468. The abrasive formulation was cured to provide the finished product.

The expandable coated abrasive material thus formed had the shape of a strip which was wound onto a reel. This strip was then used to carry out a second fining on a 6.25 cm plastic lens under a 20 pounds applied pressure for two minutes. The smoothness, (measured by $R_a$ and $R_t$) were measured at three locations, (left of center, center and right of center), on the lens face both before and after the fining operation.

The fabrics tested were:

1. a control product which is a standard commercial product comprising the same abrasive/binder formulation applied by a rotogravure technique on a non-expandable film backing. This product is sold by Norton Company under the trade designation Q-135-3 micron;
2. twelve samples in which the same abrasive/binder mixture was applied to a Spandex material in the manner described above to produce a product according to the invention; and
3. one sample in which the backing fabric was a knitted fabric available from Guilford Mills under the designation "Navy-1 Style 55051" and the resin/binder formulation was applied as described above to produce a product according to the invention.

The results of these evaluation are set forth in Table 1 below.

In the Table the $R_t$ value is the mean peak to valley distance for 9 traces each 2.5 cm long. The $R_a$ value is the roughness. Foe each parameter, lower is better.

TABLE 1

| SAMPLE | AMOUNT REMOVED | AS RECEIVED $R_a$ | AS RECEIVED $R_t$ | AFTER FINING $R_a$ | AFTER FINING $R_t$ |
|---|---|---|---|---|---|
| Control | .052 g | 14L | 132L | 5L | 38L |
| | | 17C | 133C | 5C | 37L |
| | | 16R | 141R | 6R | 41R |
| Spandex 1 | .020 g | 18L | 152L | 5L | 38L |
| | | 22C | 161C | 4C | 36C |
| | | 21R | 150R | 4R | 30R |
| Spandex 2 | .020 g | 18L | 189L | 3L | 26L |
| | | 20C | 174C | 4C | 30C |
| | | 17R | 167R | 4R | 32R |
| Spandex 3 | .019 g | 18L | 161L | 4L | 30L |
| | | 20C | 185C | 3C | 26C |
| | | 17R | 155R | 5R | 33R |
| Spandex 4 | .019 g | 15L | 132L | 4L | 26L |
| | | 21C | 156C | 4C | 29C |
| | | 18R | 166R | 6R | 36R |
| Spandex 5 | .020 g | 15L | 115L | 4L | 31L |
| | | 20C | 173C | 3C | 24C |
| | | 18R | 152R | 5R | 32R |
| Spandex 6 | .020 g | 17L | 164L | 5L | 33L |
| | | 22C | 152C | 4C | 31C |
| | | 18R | 176R | 4R | 23R |
| Spandex 7 | .019 g | 19L | 140L | 4L | 32L |
| | | 18C | 147C | 4C | 31C |
| | | 18R | 163R | 5R | 33R |
| Spandex 8 | .020 g | 17L | 150L | 5L | 29L |
| | | 20C | 140C | 4C | 33C |
| | | 18R | 176R | 5R | 32R |
| Spandex 9 | .018 g | 18L | 162L | 4L | 30L |
| | | 21C | 153C | 4C | 33C |
| | | 18R | 156R | 4R | 23R |
| Spandex 10 | .021 g | 17L | 137L | 4L | 30L |
| | | 21C | 143C | 3C | 33C |
| | | 19R | 127R | 3R | 26R |
| Navy-1 | .032 g | 19L | 166L | 4L | 29L |
| | | 21C | 188C | 4C | 30C |
| | | 16R | 138R | 5R | 36R |

As can be seen, all according to the invention performed better than the standard.

EXAMPLE 2

In this Example, two samples of backing with the same abrasive/binder composition as is described in Example 1 were evaluated in second fining a plastic lens. The figures given are averages over several evaluations. Other comments are subjective evaluations of the experimenter.

Spandex Backing Material

No wrinkling of the abrasive sheet when applied or at the end of the cycle. Material moves with the tool.

Stock Removal:

0.007 mm after 90 secs;

0.012 mm after 120 secs.

Final Surface Finish:

1.80 micron $R_t$;

$R_a$ 0.318 micron.

Navy-1 Backing Material

No wrinkling of the abrasive sheet when applied or at the end of the cycle. Material moves with the tool.

Stock Removal:

0.008 mm after 30 secs.

0.010 mm after 60 secs.

0.020 mm after 360 secs.

Final Surface Finish:

$R_t$ 0.943 micron;

$R_a$ 0.205 micron.

What is claimed is:

1. Coated abrasive material having length and width dimensions and comprising a substrate selected from the group consisting of woven and knit materials having a weight of less than about 250 g/m$^2$ and abrasive particles bonded directed to the substrate in a spaced discontinuous pattern, the coated abrasive material having a recovery of at least 80% when subjected to a strain producing an elongation of at least 50% in the length direction or at least 25% in the width direction.

2. Coated abrasive material according to claim 1 in which the recovery after a strain producing elongation of 90% in the length direction or about 35% in the width direction, is about 100%.

3. Coated abrasive material according to claim 1 in which the substrate material is an elastic knit fabric.

4. Coated abrasive material having length and width dimensions and comprising a substrate material having a surface comprising a spaced pattern of raised knuckle areas selected from the group consisting of woven and knit materials having a weight of less than about 250 g/m$^2$ and abrasive particles bonded to the substrate material wherein the abrasive particles are adhered substantially exclusively to said knuckle areas of the material in a spaced discontinuous pattern, the coated abrasive material having a recovery of at least 80% when subjected to a strain producing an elongation of at least 50% in the length direction or at least 25% in the width direction.

5. Coated abrasive material according to claim 1 in which the abrasive particles have a FEPA grit size of 180 grit or smaller.

6. Coated abrasive materials according to claim 1 in which the abrasive particles are alumina.

* * * * *